US005432978A

United States Patent [19]

Menke et al.

[11] Patent Number: 5,432,978

[45] Date of Patent: Jul. 18, 1995

[54] FIRE FIGHTING TOOL FOR ATTACHMENT TO A PIKE POLE

[75] Inventors: W. Kenneth Menke; W. Kenneth Menke, III, both of Glendale, Mo.

[73] Assignee: The Ahrens-Fox Fire Engine Company, Webster Groves, Mo.

[21] Appl. No.: 124,608

[22] Filed: Sep. 20, 1993

[51] Int. Cl.[6] ..... A47B 95/02

[52] U.S. Cl. ..... 16/114 R; 16/111 R

[58] Field of Search ..... 16/110 R, 111 R, 114, 16/113; 403/234, 233, 235, 236, 237, 191, 190; 273/81.2; 269/131

[56] References Cited

U.S. PATENT DOCUMENTS

| | | | |
|---|---|---|---|
| 627,489 | 6/1899 | Ekstrand . | |
| 667,853 | 1/1901 | Sands . | |
| 1,572,995 | 2/1926 | Gate | 403/233 |
| 1,945,430 | 1/1934 | Garrett | 403/234 |
| 2,297,577 | 9/1942 | Monte | 16/111 R |
| 2,391,553 | 12/1945 | Decker, Jr. | 403/235 |
| 2,427,353 | 9/1947 | Gagesteyn . | |
| 2,522,190 | 9/1950 | Mouser . | |
| 2,655,824 | 10/1953 | Land et al. . | |
| 3,341,235 | 9/1967 | Mattson et al. | 16/114 R |
| 3,507,270 | 4/1970 | Ferrier . | |
| 4,368,556 | 1/1983 | Wanner et al. | 16/111 R |
| 4,911,575 | 3/1990 | Tidwell | 16/114 R |
| 4,978,100 | 12/1990 | Peurifoy . | |

*Primary Examiner*—P. Austin Bradley
*Assistant Examiner*—Chuck Y. Mah
*Attorney, Agent, or Firm*—Rogers, Howell & Haferkamp

[57] ABSTRACT

A fire fighting tool provides a handle that is removably and adjustable attached to a pole (or similar instrument) at a convenient location along the length and about the circumference of the pole. The tool is constructed to orient the handle generally perpendicularly to the axis of the pole to which the tool is attached, and to maintain the relative orientation of the handle and the pole as forces are exerted manually on the handle and transmitted to the pole by the tool. The tool enables a user of the tool to apply a greater amount of their available strength in manipulating the tool.

19 Claims, 1 Drawing Sheet

FIRE FIGHTING TOOL FOR ATTACHMENT TO A PIKE POLE

BACKGROUND OF THE INVENTION (1) Field of the Invention

The present invention provides a fire fighting tool that is designed to be releasably and adjustably attached to the length of a conventional pike pole. Once attached to the pike pole, the tool provides a handle that projects perpendicularly from the pike pole that enhances the fire fighter's ability to exert a pushing or pulling force on the pike pole.

(2) Description of the Related Art

The pike pole is among the oldest tools used for fire fighting and remains the most practical way of pulling down structure to expose pockets of fire. Particularly useful for removing ceilings, the pike pole and modern variants are in daily use by virtually every fire department in the United States.

Over the years, the conventional pike pole has undergone various modifications in an attempt to make it easier to penetrate structure, whether the structure be lath and plaster, drywall, pressed tin or lightweight wood panels, and then hook into the structure to pull the structure down from a building ceiling or wall. The length of the pike pole has also been modified with some poles being provided with a D-shaped handle opposite the pole tip. The D-shaped handle made it easier for a fire fighter to maintain a grip on the pike pole while pulling down structures, but the added bulk of the D-shaped handle made the modified pike poles difficult to stow in standard pike pole racks of fire equipment and also allowed no adjustment of the handleposition along the length of the pike pole or in the orientation of the handle relative to the pole tip.

Over recent years the requirements of fire fighters have also changed, placing less emphasis on the physical strength of the fire fighter. It is no longer a given that all of the fire fighters at the scene of a fire will be over five foot ten inches tall and over 175 pounds. Jobs that require a strong grip-and upper body strength, such as pulling ceilings, are very difficult for smaller fire fighters to perform safely with the conventional configuration of the fire fighting pike pole. Adding to the problem is the continuing reduction in the fire fighter crew size. Forty years ago, five man engines and six man trucks were common. Today, three man crews are common and two man crews are not unknown. In many cases, rotating crews on physically demanding jobs like pulling ceilings is simply not possible due to the shortage of fire fighters.

SUMMARY OF THE INVENTION

The present invention provides a fire fighting tool that is adapted to be releasably and adjustably attached to a conventional pike pole to make use of the pike pole less demanding on the stamina of the fire fighter. The tool is comprised of a handle attached to a base of the tool, a resilient pressure plate adjustably received in the base, and a strap looped over the pressure plate.

The tool is attached to the length of a conventional pike pole with the pressure plate positioned adjacent one side of the pole and the strap extending around the opposite side of the pole. An adjustment key extends through the tool handle. Rotation of the key extends the pressure plate from the base and into engagement with one side of the pike pole, and thereby causing the opposite side of the pike pole to engage against the strap. This adjustment of the pressure plate attaches the tool securely to the pike pole with the handle projecting generally perpendicularly from the pike pole.

The attached tool may be used to exert a pushing, pulling, or torsional force on the pike pole by the fire fighter. The attached tool reduces the potential of the pike pole sliding through the closed hands of the fire fighter, and a greater percentage of the fire fighter's strength can be applied to manipulating the pike pole. The net effect is that a fire fighter of smaller stature can perform tasks in a safe manner that would be very difficult using the conventional pike pole. The same increase in efficiency also applies to fire fighters of larger stature and enables them to work safely for longer periods of time without relief.

The tool is easily loosened and relocated along the length of the pike pole, or can be completely removed from the pole for storage. Additionally, several of the tools can be attached to a single pike pole to use one tool for pushing up and another for pulling down on the pike pole, or to permit two or more fire fighters to work together with the same pole.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
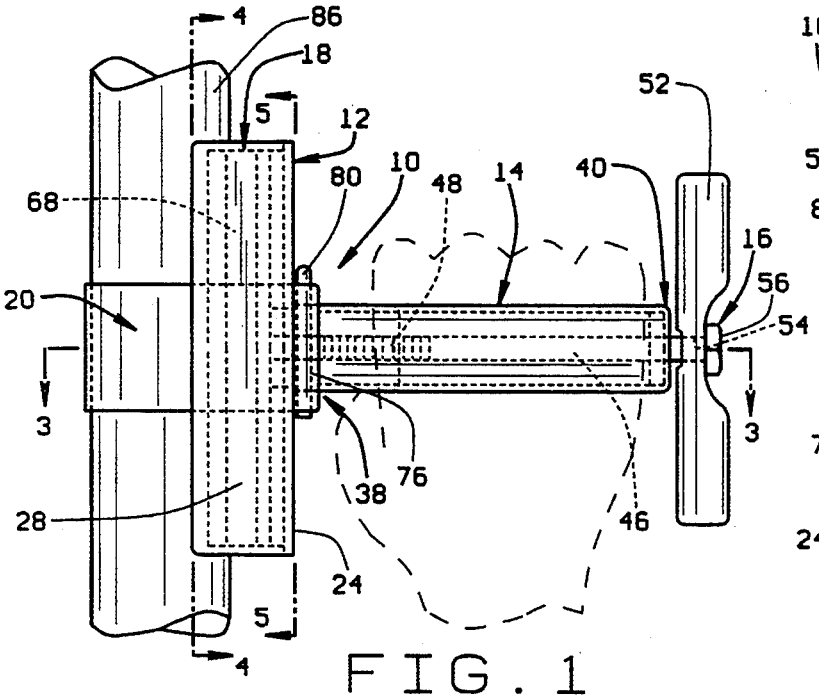
FIG. 1 is a side view of the fire fighting tool of the present invention showing its attachment to a portion of the axial length of a conventional pike pole.
Figure 2:
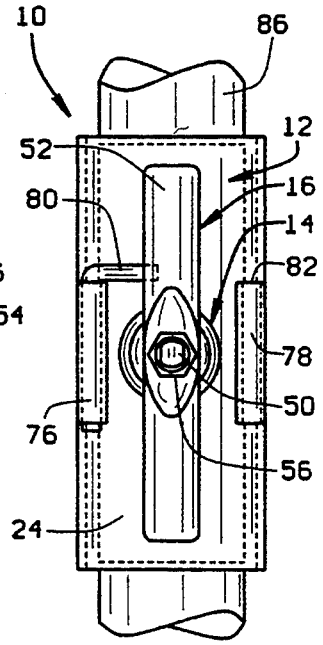
FIG. 2 is an end view of the fire fighting tool of the invention.
Figure 3:
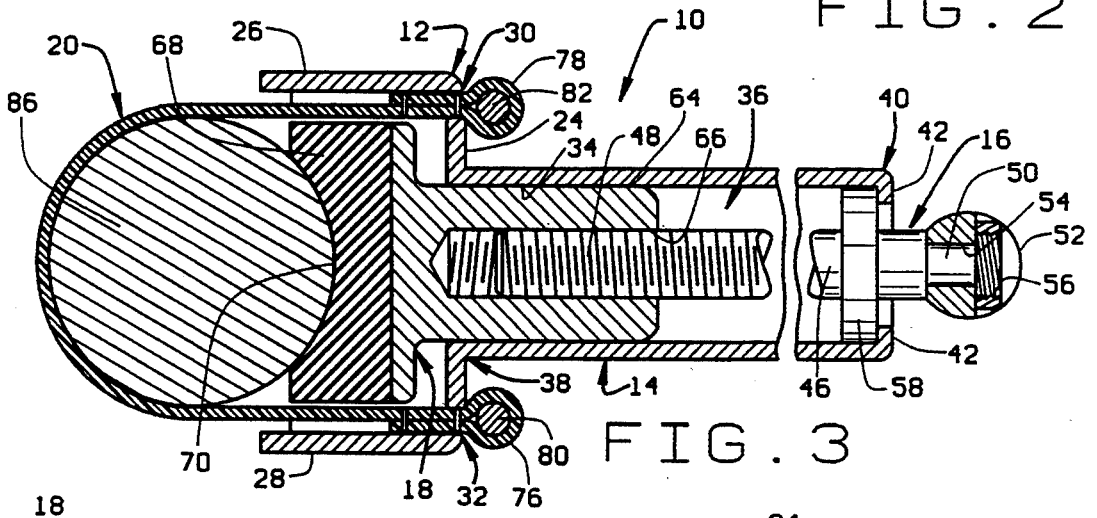
FIG. 3 is a plan view, in section, of the tool taken along the plane 3—3 of FIG. 1.
Figure 4:
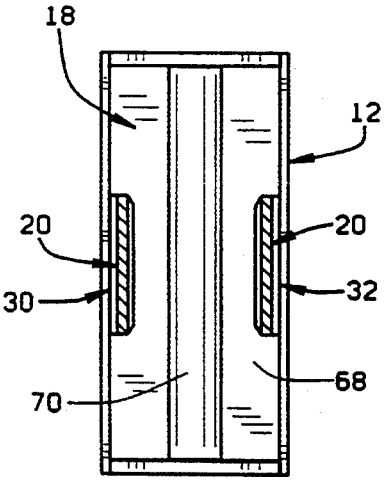
FIG. 4 is an end elevation view, partially in section, of the tool taken along the plane 4—4 of FIG. 1.
Figure 5:
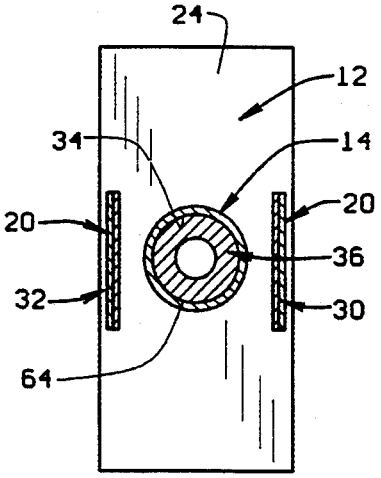
FIG. 5 is an-end elevation view, partially in section, taken along the plane 5—5 of FIG. 1.

The inventive tool that is the subject of this application is described herein as being used with a conventional fire fighting pike pole in its preferred embodiment. This description is for illustrating purposes and should not be interpreted as limiting the scope of the invention defined in the claims. The tool of the invention may be used with various different types of instruments having pole handles similar to that of the fire fighting pike pole.

The fire fighting tool 10 of the present invention is basically comprised of a base 12, a handle 14, an adjustment key 16, a pressure plate 18 and a strap 20.

The base 12 has the general configuration of a U-shaped channel member with a web 24 and opposite side walls 26, 28 extending along the length of the base. As seen in the drawing figures, the length of the base 12 is significantly longer than its width and enables the base to maintain the handle 14 in a generally perpendicular orientation relative to a pike pole to which the tool 10 is attached as will be explained. A pair of elongated slots 30, 32 are provided through the web portion 24 of the base and a center opening 34 also extends through the web portion 24 between the pair of slots.

The handle 14 has the configuration of an elongated hollow cylinder with a first end 38 of the handle secured to the web portion 24 of the base surrounding the web portion center opening 34. The handle projects perpendicularly from the base 12 to its second end 40. The handle second end 40 is formed with an annular shoulder 42 that projects inwardly toward the hollow interior 36 of the handle.

The adjustment key 16 includes an elongated rod 46 having screw threading 48 formed at a first end of the rod and a post 50 with a square cross section projecting from the second end of the rod. A key head 52 designed to be manually gripped for turning the key is attached to the post 50 at the second end of the rod. The key head 52 has a square hole 54 extending through its center through which the post 50 of the rod is inserted. The distal end of the post 50 has screw threading thereon and a nut fastener 56 is threaded over the post screw threading to attach the key head 52 to the second end of the rod 46. A collar 58 is formed on the rod 46 adjacent its second end 50. The collar is dimensioned to be received in the hollow interior 36 of the handle 14 to enable rotation of the rod within the handle interior, However, the diameter of the collar 58 causes the collar to engage with the annular shoulder 42 at the handle second end, thereby preventing the key rod 46 from completely passing through the handle interior and out of the interior at the handle second end.

The pressure plate 18 has the general configuration of a rectangular plate having a length and width substantially equal to the length and width of the base web 24. A cylindrical stub 64 projects from one side of the pressure plate at the center of its length. The stub 64 has a cylindrical exterior configuration dimensioned to enable the stub to be received in the interior volume 36 of the handle 14. A screw threaded cavity 66 extends through the center of the stub with the internal screw threading of the cavity being complementary to the external screw threading at the first end of the key rod 46. A block of resilient, compressible material 68 is secured to the opposite side of the pressure plate 18 from the stub 64. The block of resilient material 68 has a length dimension and a width dimension substantially equal to that of the pressure plate 18. A surface of the material 68 opposite the pressure plate has a concave depression 70 formed therein that extends the length of the block. In the preferred embodiment of the invention, rubber is employed as the material of the block 68. However, other equivalent types of resilient material may be employed in constructing the block.

The strap 20 is preferably constructed of a length of nylon; however, other similar flexible and durable materials may be employed. The strap is constructed having an elongated configuration with loops 76, 78 formed in the opposite ends of the strap. A pair of pins 80, 82 are inserted through the loops 76, 78 at the opposite ends of the strap, and one of the pins 80 has an L-shaped configuration.

In assembling the component parts of the tool 10, the key rod 46 is first inserted through the handle interior 36 from the first end of the handle 38 toward the second end 40 until the collar 58 engages against the handle annular shoulder 42 and the rod post 50 projects from the handle second end. The key head 52 is then positioned over the rod post 50 and is secured thereto by the nut fastener 56 being tightened down over the screw threading of the post.

The stub 64 of the pressure plate 18 is next inserted into the handle interior volume 36 from the first end 38 of the handle. The length of the pressure plate 18 is aligned with the length of the base 12 to enable the pressure plate to be completely received within the U shape of the base. The pressure plate stub 64 is inserted into the handle interior until the opening of the screw threaded cavity 66 engages with the screw threaded first end 48 of the key rod 46. The key 16 is then rotated to screw thread the key rod first end 48 into the threaded cavity 66 of the pressure plate stub thereby attaching the pressure plate to the key and attaching the pressure plate to the base for adjustable movement of the pressure plate relative to the base. By rotating the key 16 in opposite directions, the position of the pressure plate 18 relative to the base can be adjusted between an extended position and a retracted position.

The strap 20 is attached to the base 12 by inserting the pair of loops 76, 78 (with the pins 80, 82 removed) through the slots 30, 32 in the base web portion. With the loops inserted through the slots, the pins 80, 82 are then inserted into the loops to prevent their being pulled back through the slots. The one pin 80 is provided with an L shape to facilitate its removal from its associated strap loop 76, enabling the one end of the strap to be easily disconnected from the base.

The assembled fire fighting tool 10 may be attached to the length of a conventional pike pole 86 in two ways. To prepare the tool for attachment to the pike pole, the key 16 is first rotated to retract the pressure plate collar 64 into the handle interior 36 to its fullest extent, and thereby retract the pressure plate block 68 to its fullest extent within the U shape of the base 12. This provides ample clearance to enable the looped strap 20, with its opposite ends connected to the base, to be passed over the end of the pike pole 86 opposite its tip and then adjustably positioned along the length of the pike pole to any desired position. Once moved to its desired position along the length of the pike pole, rotating the key 16 to extend the pressure plate 18 from the base 12 will cause the concave depressions 70 of the pressure plate block 68 to engage against one side of the pike pole while the strap 20 engages against the opposite side of the pike pole, thereby securely gripping the tool 10 to the pike pole in its desired position.

With the fire fighting tool 10 attached to the pike pole 86 as shown in FIG. 1, a fire fighter may pull or push on the handle 14 of the tool to exert a pulling or pushing force along the length of the pike pole. Moreover, the gripping connection provided by the strap 20 and the pressure plate block 68 enables the fire fighter to exert a force on the pike pole transverse to its center axis to rotate the pole about its axis. The elongated length of the base 12 and the pressure plate 18 maintain the tool handle 14 in its generally perpendicular orientation relative to the axis of the pike pole 86 as the fire fighter exerts pushing and pulling forces on the handle. Should it be desired to remove the tool or reposition the tool on the pike pole, the fire fighter need only rotate the key 16 to retract the pressure plate 18 back into the U-shaped configuration of the base 12, thereby loosening the grip of the tool on the pike pole and enabling the tool to be adjustably repositioned along the length of the pike pole. Alternatively, the one pin 80 may be pulled from its loop 76 in the strap 20 enabling the one end of the strap to be pulled from the base slot 32, thereby quickly disconnecting the tool 10 from the length of the pike pole. To reattach the tool to the pike pole, the pressure plate 18 is positioned against one side of the pike pole while the strap is wrapped around the opposite side and reinserted through its associated slot 32 in the base. The one pin 80 is then reinserted into the loop 76 at the end of the strap securely connecting both ends of the strap to the tool base. The key 16 is then rotated to tighten the grip of the tool on the pike pole in the manner explained above.

The fire fighting tool 10 of the present invention provides a handle that is easily attached perpendicularly to the length of a pike pole (or similar tool) at any convenient location along the length of the pole. The tool enables a fire fighter to exert a greater amount of his available strength in pushing, pulling or rotating the pike pole by reducing the possibility of the pike pole from slipping through the fire fighter's closed hands. The tool enables a fire fighter of lesser physical abilities to perform tasks in a safe manner that would be very difficult using conventional equipment. Additionally, several of the fire fighting tools 10 may be attached to the same pike pole to use one for pushing the pole and one for pulling the pole, or to enable several fire fighters to work together on the same pole.

Although the fire fighting tool 10 of the present invention has been described with reference to its use on a conventional fire fighting pike pole, it should be understood that the tool 10 may be employed in facilitating working with various other similar tools. It is not intended that the tool 10 of the invention be limited in use only with a conventional fire fighting pike pole, and it should be understood that the tool of the invention may be employed with a variety of similar types of tools and instruments having either a circular or polygonal cross section.

While the present invention has been described by reference to a specific embodiment, it should be understood that modifications and variations of the invention may be constructed without departing from the scope of the invention defined in the following claims.

What is claimed is:

1. A tool adapted to be removably and adjustably attached to a pole, and adapted to be gripped for exerting pushing and pulling forces on the pole, the tool comprising:

an elongated handle having opposite first and second ends;

a base connected to the handle at the handle first end, the base having a length that extends at an angle relative to the handle; and, means for removably attaching the base to a pole with the length of the base extending substantially parallel to an axial length of the pole, the means for removably attaching the base to the pole including a pressure plate mounted to the base for selective adjustable movement of the pressure plate away from the base toward an extended position of the pressure plate relative to the base, and for selective adjustable movement of the pressure plate back toward the base to a retracted position of the pressure plate relative to the base, the pressure plate being adapted to engage against one side of the pole.

2. The tool of claim 1, wherein:

the base includes means for maintaining the handle at a set angle relative to the pole to which the base is attached while the handle is gripped and pushing and pulling forces are exerted on the handle and transferred to the pole.

3. The tool of claim 2, wherein:

the means for maintaining the handle at a set angle relative to the pole to which the base is attached includes a pressure plate mounted to the base, the pressure plate having a length that extends in opposite directions from the handle, the pressure plate length being configured to engage along a portion of the axial length of the pole and to be secured thereto by the means for attaching the base to the pole, and the pressure plate length engaging along the portion of the axial length of the pole functioning to maintain the handle at the set angle relative to the pole.

4. The tool of claim 3, wherein:

the set angle of the handle relative to the pole is substantially a perpendicular angle.

5. The tool of claim 1, wherein:

the means for removably attaching the base to the pole includes means for exerting a force on the pole on an opposite side of the pole from the base.

6. The tool of claim 5, wherein:

the means for exerting a force on the pole on an opposite side of the pole from the base is connected to the base and extends around at least one side of the pole to an opposite side of the pole from the base.

7. The tool of claim 4, wherein:

the means for exerting a force on the pole on an opposite side of the pole from the base includes a strap having opposite ends connected to the base, the strap being attachable around the pole to exert a force on an opposite side of the pole from the base.

8. the fire fighting tool of claim 7, wherein:

at least one end of the strap is releasably attached to the base.

9. The tool of claim 7, wherein:

the pressure plate is adapted to exert a force on a side of the pole as the pressure plate is adjustably moved away from the base toward its extended position.

10. The tool of claim 7, wherein:

the strap is adapted to exert a force on the pole on an opposite side of the pole from the base and the pressure plate is adapted to exert a force on the pole on a side of the pole adjacent to the base as the base is removably attached to the pole.

11. The tool of claim 1, wherein:

the pressure plate has a resilient engagement surface adapted to engage against and be compressed by a side of the pole to which the base is removably attached.

12. The tool of claim 1, wherein:

the means for removably attaching the base to a pole is adapted for attaching the base to both a pole having a circular cross section and to a pole having a polygonal cross section.

13. The tool of claim 1, wherein:

the means for removably attaching the base to a pole includes means for adjustably positioning the base along an axial length of the pole and circumferentially around the pole.

14. A fire fighting tool adapted to be removably attached to a pike pole and adjustably positioned on the pike pole to which it is attached, the tool comprising:

a base having opposite ends and a length extending between its opposite ends;

a handle connected to the base between the base opposite ends and extending generally perpendicularly relative to the length of the base;

a pressure plate having a length substantially aligned with the length of the base, the pressure plate being mounted to the base for selective adjustable movement of the pressure plate toward an extended position of the pressure plate relative to the base and toward a retracted position of the pressure plate relative to the base; the pressure plate being adapted to engage against one side of a pike pole with the length of the pressure plate extending along an axial length of the pike pole to thereby maintain the handle at a generally perpendicular orientation relative to the axial length of the pike pole; and, means attached to the base for extending around at least one side of the pike pole and engaging against a second side of the pike pole generally opposite the one side of the pike pole engaged by the pressure plate, whereby the pike pole is gripped between the means extending around and engaging against the second side of the pike pole and the pressure plate engaging against the one side of the pike pole as the pressure plate is adjustably moved toward the extended position of the pressure plate from the base.

15. The fire fighting tool of claim 14, wherein:

the means extending around and engaging against the second side of the pike pole includes a strap having opposite ends attached to the base.

16. The fire fighting tool of claim 15, wherein:

a pin extends through one end of the strap and attaches the strap to the base, whereby withdrawing the pin from the one end of the strap releases the one end of the strap from its attachment to the base.

17. The fire fighting tool of claim 14, wherein:

the pressure plate has a resilient engagement surface adapted to engage against and generally conform to a shape of a pike pole with which the engagement surface is engaged.

18. The fire fighting tool of claim 14, wherein:

a manually rotatable key with a head at one end and screw threading at a second end is inserted through the handle, the screw threading of the key is received in a complimentary screw threaded cavity on the pressure plate, whereby rotation of the key head in one direction relative to the handle causes the pressure plate to move toward its extended position relative to the base, and rotation of the key head in a second direction relative to the handle causes the pressure plate to move toward its retracted position relative to the base.

19. A fire fighting tool adapted to be removably attached to a pike pole and adjustably positioned on the pike pole to which it is attached, the tool comprising:

a base having opposite ends and a length extending between its opposite ends;

a handle connected to the base between the base opposite ends and extending generally perpendicularly relative to the length of the base;

a pressure plate having a length substantially aligned with the length of the base, the pressure plate being mounted to the base for selective adjustable movement of the pressure plate toward an extended position of the pressure plate relative to the base and toward a retracted position of the pressure plate relative to the base; the pressure plate being adapted to engage against one side of a pike pole with the length of the pressure plate extending along an axial length of the pike pole to thereby maintain the handle at a generally perpendicular orientation relative to the axial length of the pike pole; and, means attached to the base for extending around at least one side of the pike pole and engaging against a second side of the pike pole generally opposite the one side of the pike pole engaged by the pressure plate, the means extending around and engaging against the second side of the pike pole including a strap having opposite ends attached to the base and a pin extending through one end of the strap and attaching the strap to the base, whereby withdrawing the pin from the one end of the strap releases the one end of the strap from its attachment to the base, the pike pole being gripped between the means extending around and engaging against the second side of the pike pole and the pressure plate engaging against the one side of the pike pole as the pressure plate is adjustably moved toward the extended position of the pressure plate from the base.

* * * * *